United States Patent [19]

Collins

[11] 4,003,161

[45] Jan. 18, 1977

[54] MECHANICAL BARRIER

[76] Inventor: Wesley A. Collins, 1315-C Via Santiago, Corona, Calif. 92720

[22] Filed: Mar. 1, 1976

[21] Appl. No.: 662,477

[52] U.S. Cl. ..... 49/35; 49/49; 49/131

[51] Int. Cl.[2] ..... E01F 13/00

[58] Field of Search ..... 49/35, 49, 131–134; 70/379, 380

[56] References Cited

UNITED STATES PATENTS

| | | | |
|---|---|---|---|
| 1,515,611 | 11/1924 | O'Connor | 70/379 R X |
| 3,061,960 | 11/1962 | Dull | 49/131 X |
| 3,086,430 | 4/1963 | Emmel | 49/49 X |
| 3,417,508 | 12/1968 | Sprung | 49/35 |
| 3,564,769 | 2/1971 | Wilson et al. | 49/35 |
| 3,673,734 | 7/1972 | Goldberg | 49/35 |
| 3,698,135 | 10/1972 | Boots et al. | 49/35 |

FOREIGN PATENTS OR APPLICATIONS

| | | | |
|---|---|---|---|
| 1,401,359 | 4/1965 | France | 49/35 |

*Primary Examiner*—Philip C. Kannan

[57] ABSTRACT

A collapsible or removable post which may be key-locked in its upright position and in its stowed position. The post may be used to hold a sign or to act as a temporary barrier in order to block a traffic lane, a driveway or the access to, or egress from, a parking spot. The device comprises a movable inner post telescopically inserted into a ground imbedded container. A locking lever inside the post, actuated by a keylock, secures it at various height positions above ground level.

2 Claims, 13 Drawing Figures

MECHANICAL BARRIER

BACKGROUND OF THE INVENTION

It sometimes becomes necessary to place a temporary barrier to vehicular traffic across a road, lanes, or an entrance and exit driveway. This is commonly accomplished by installing light portable fixtures such as sawhorses or free standing sign posts. This type of obstacles, however, can be easily moved aside or knocked down by a trespasser. Furthermore, they are awkward to handle and cumbersome to store when not in use.

There has never been a simple and efficient way to secure an assigned parking area around a business establishment or a multi-unit residence in the absence of the owner's vehicle.

"Reserved," or "No Parking" signs, and other notices often remain unheeded by hurried drivers. The returning space owner is then left with the frustration of having to find another open parking slot.

SUMMARY OF THE INVENTION

The present invention provides:

an inexpensive and efficient means for temporarily blocking a lane of traffic or driveway, which is easy to handle and unobtrusive in its stowed position;

convenient means for forbidding the access to an assigned parking spot to unauthorized vehicles;

a temporary barrier, sign post, or anchoring post for small aircraft, which can be keylocked into place; and in general, a multipurpose removable post, which may be keylocked in its upright position, and in its stowed position.

DRAWINGS

DESCRIPTION OF THE PREFERRED EMBODIMENTS OF THE INVENTION

Figure 3:
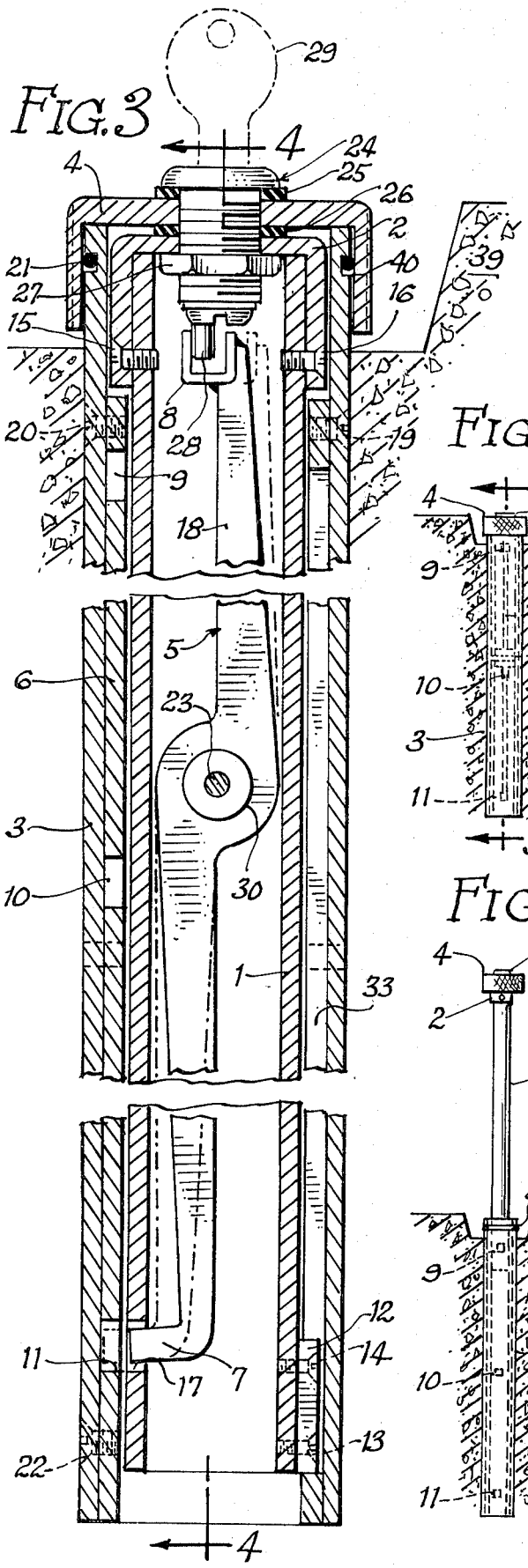
FIG. 3 is a cross sectional view of the device taken along line 3—3 of FIG. 1.
Figure 1:
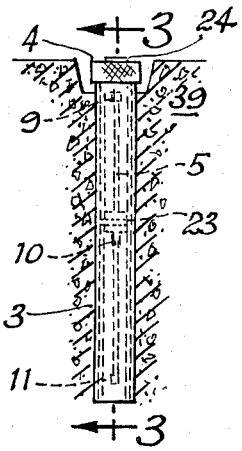
FIG. 1 is a front elevation of a ground imbedded version of the present invention shown is the stowed position.
Figure 2:
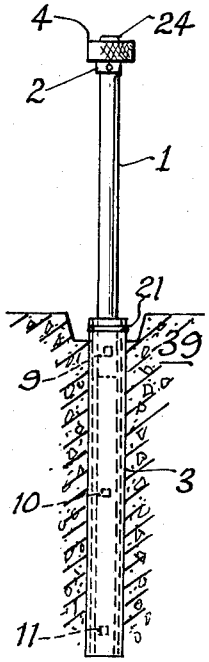
FIG. 2 is a front elevation of the device shown in FIG. 1 in the fully raised position.
Figure 4:
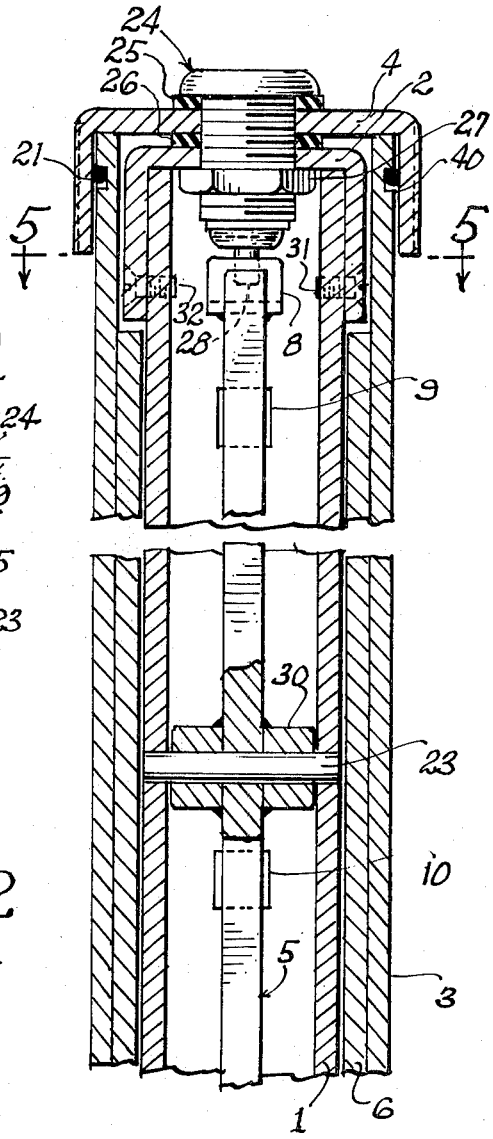
FIG. 4 is a cross sectional view of the device taken along 4—4 of FIG. 3.
Figure 5:
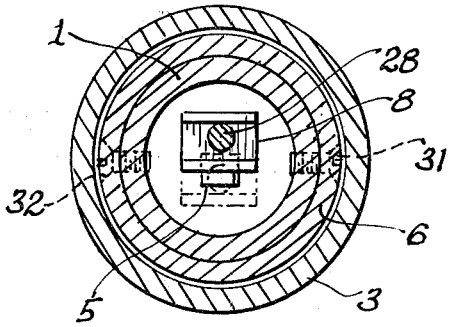
FIG. 5 is a cross sectional view of the device taken along line 5—5 of FIG. 4.

Referring now to the drawings, and more particularly to FIGS. 1 through 5, a movable post is illustrated slideably engaged into a tubular receptacle 3, which is imbedded in the floor 39 of a concrete driveway.

A tubular sleeve 6, fastened to the inside of the receptacle 3 by screws 19, 20, and 22, has a longitudinal slot 33 extending almost the full length of the sleeve. Opposite the slot 33 three holes 9, 10, and 11 are drilled at various height locations forming three mortised areas.

A short upper section of the receptacle 3 extending above ground has a horizontal groove 40 around its outer edge holding an "O" ring 21 of rubber or similar material.

The post comprises a tubular enclosure 1, in which a lever 5 is pivotally fastened by a pin 23 running through the hub 30, and the walls of the enclosure 1. The lower end of lever 5 is bent at right angle to form a bolt 7, which protrudes through a hole 17 in the side of enclosure 1.

A gutter shaped bracket 8 is welded to the upper end of lever 5.

A cap 2 is fastened to the top of the enclosure 1 by screws 15, 16, 31 and 32. Mounted concentrically with, and above, cap 2 a larger cap 4 engages the upper section of receptacle 3 when the post is fully lowered into said receptacle 3.

A keylock 24 inserted through washer 25, a hole in the center of cap 4, washer 26, and through a hole in the center of cap 2 is secured by nut 27.

Washers 25 and 26 are made of rubber or other similar material.

The bolt of the lock 24 is formed by a prong 28 extending downward from the lock 24, and engaging the gutter-shaped bracket 8.

The prong 28 is mounted eccentrically so that when the key 29 is turned, the prong 28 travels laterally, moving the lever 5.

A small rectangular piece forming a key 12 is fastened near the lower end, and on the outside wall of enclosure 1 by screws 13 and 14. This key 12 travels within slot 33 to keep bolt 7 of lever 5 in line with mortised areas 9, 10 and 11.

The key 12 prevents the post from coming completely out of receptacle 3 when it hits the upper end of slot 33.

It also provides a stable stop location for locking the post in the fully raised position.

The tubular elements used to make the receptacle 3, sleeve 6 and the post enclosure 1 may have a circular cross section or a polygonal cross section.

When using tubular elements having a polygonal cross section the key 12 and slot 33 are not needed for alignment, and the sleeve 6 can be omitted. The mortised area can then be drilled directly into the wall of the receptacle 3.

The O ring 21 and washers 25 and 26 are designed to minimize the seepage of water and moisture into the barrier assembly.

Figure 6:
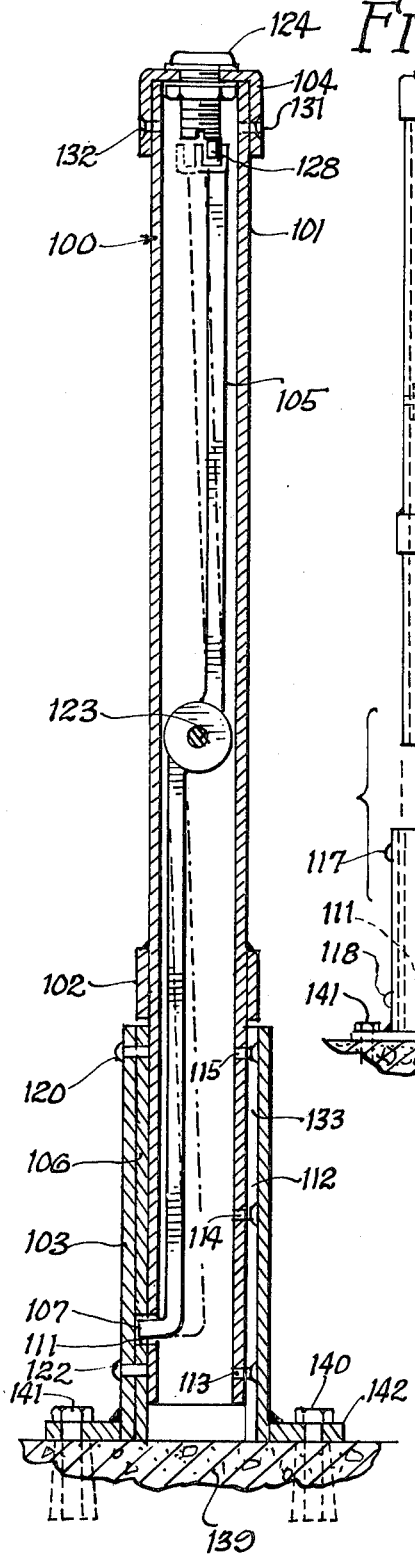
FIG. 6 is a side cross sectional view of a surface mounted version of the present invention.
Figure 7:
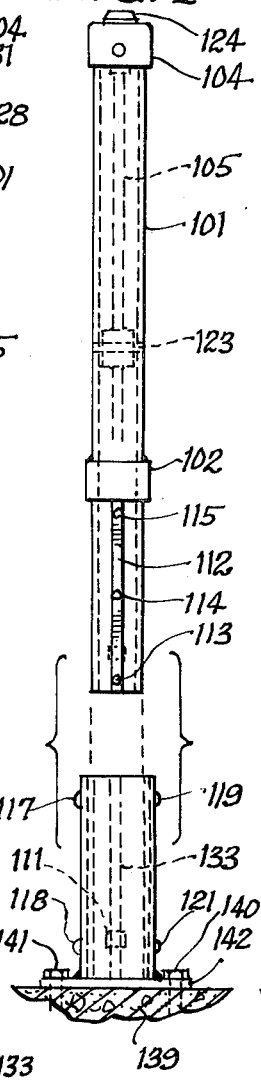
FIG. 7 is a front elevation of the removable, surface mounted version of the device shown outside its support.

Referring now to FIGS. 6 and 7, an alternate embodiment of the present invention is shown having a surface mounted receptacle 103.

The receptacle 103 is fastened to the ground surface 139 by bolts 140 and 141, driven through the flanged footing 142.

The sleeve 106, fastened to the receptacle 103 by pins or screws 117, 118, 119, 120, 121 and 122, has a slot 133 which extends over its whole length. Only one mortised area 111 is provided in the lower portion of the post.

The post comprises the tubular enclosure 101 having a locking mechanism similar to the one described above. The locking mechanism is formed by lever 105 pivotally fastened inside the enclosure 101 by pin 123, the key lock 124 having an eccentric prong 128 mounted in the center of cap 104.

The guide or key 112 extends the full length of slot 133, and is fastened by screws 113, 114 and 115 to the lower part of the enclosure 101.

A collar 102 circles the enclosure 101 just above the upper end of receptacle 103, and provides a stop location at which the bolt 107 is properly aligned with mortised area 111.

Alternatively the sleeve 106 could be omitted by having a key fastened directly to the inside of receptacle 103, and providing for a matching slot along the lower part of enclosure 101. The mortised area could be drilled directly into the wall of receptacle 103.

Figure 8:
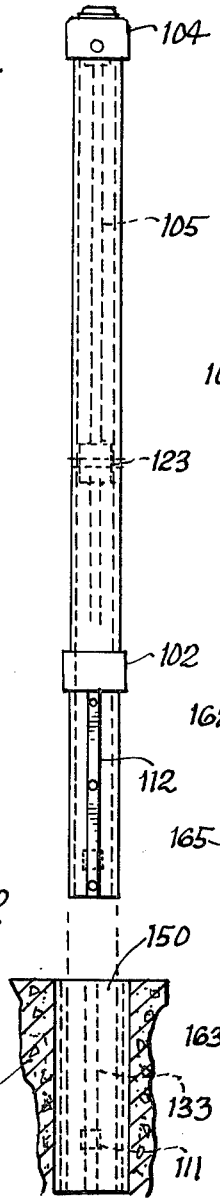
FIG. 8 is a front elevation of an alternate embodiment of the removable device having a ground imbedded support.

FIG. 8 shows another non-collapsible version of the invention in which a short receptacle 150 is imbedded into the ground surface 138.

Figure 9:
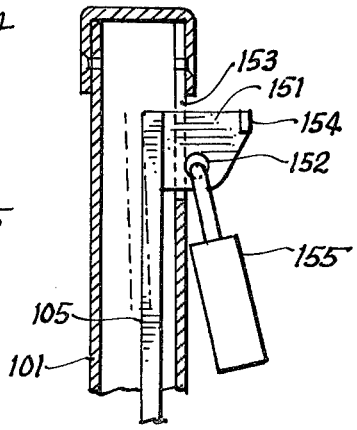
FIG. 9 is a cross sectional view of a post showing an alternate lever locking mechanism.

FIG. 9 shows an alternate locking device wherein the keylock has been replaced by a padlock 115.

A flat piece of metal 151 forming an ear is welded to the upper end of lever 105, and protrudes through a slot 153 in the side of the enclosure 101.

A padlock hole 152, drilled through the ear, is exposed to the outside of the enclosure 101 when the lever 105 is pulled to the locked position.

The ear 151 has a small bent corner area 154 to facilitate manual pulling of the lever 105 to the locked position.

Figure 10:
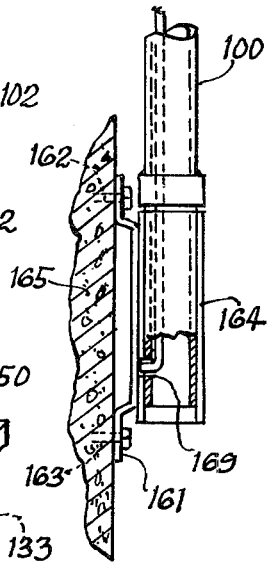
FIG. 10 is a side view of a wall mounted support.
Figure 11:
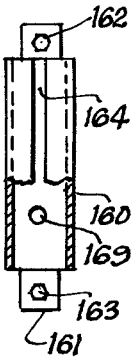
FIG. 11 is a front view of a wall mounted support with a section cut away.

FIGS. 10 and 11 illustrate a wall-mounted support which comprises a receptacle 160, welded to a wall-hanging bracket 161. A slot 164 extends the whole length of the receptacle 160, opposite to a hole 169, forming a mortised area for the bolt 107 of post 100.

Figure 12:
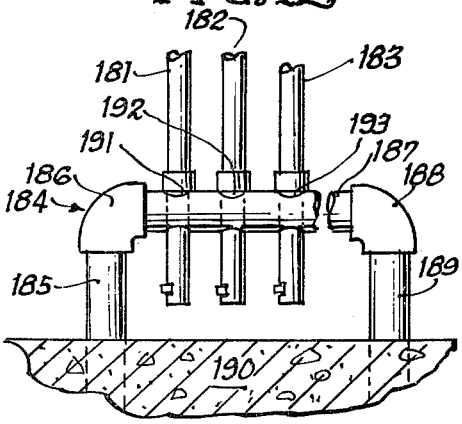
FIG. 12 is a front view of a multi-unit support bracket.

FIG. 12 shows an above-ground type of receptacle holding a plurality of posts, which comprises a horizontal tubular member 187 having a plurality of transversal holes 191, 192 and 193, designed to receive the lower end of posts similar to the one described in FIG. 6.

At each end of the tubular member 187 a pair of tubular elbows 186 and 188 connect to two tubular sections 185 and 189, which are planted into the ground 190.

Figure 13:
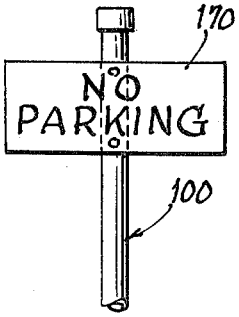
FIG. 13 is a front view of the upper part of a post supporting a sign.

FIG. 13 shows a post 100 carrying a "No Parking" sign.

All the above tubular elements used as receptacles, posts, sleeves, and supports are cut from standard size steel pipes stock. All caps, elbows, collars and flanged footings are also standard plumbing hardware.

It will be apparent to those skilled in the mechanical art that other variations may be made in the details of construction and application without departing from the spirit and scope of this invention as defined in the pending claims.

What is claimed is:

1. A temporary barrier which comprises:

a ground imbedded receptacle comprising an outer tube with a short upper section extending above ground, a sleeve fastened to the inside of said outer tube having a plurality of holes at various depth positions forming mortised areas;

a movable post comprising a tubular enclosure slidably engaged into said sleeve, a cap closing the upper section of said enclosure, a lever pivotally mounted within said enclosure, a bolt at the lower part of said lever engaging said mortised areas, actuating means in the upper part of said lever and of said cap, a larger concentric cap fastened above said cap and fitting the upper end section of said outer tube.

2. A temporary barrier according to claim 1 wherein said outer tube, said sleeve, said tubular enclosure are made from sections of standard size pipe stock.

* * * * *